US005533947A

United States Patent [19]

Tomlinson et al.

[11] Patent Number: 5,533,947

[45] Date of Patent: Jul. 9, 1996

[54] MUSICAL BEAT JUMP-ROPE

[76] Inventors: Roger R. Tomlinson; Laura J. Baptista, both of 4575 Amberwood, La Palma, Calif. 90623

[21] Appl. No.: 331,941

[22] Filed: Oct. 31, 1994

[51] Int. Cl.[6] ..... A63B 21/00

[52] U.S. Cl. ..... 482/6; 482/81; 482/82

[58] Field of Search ..... 482/81, 82, 6; 446/213

[56] References Cited

U.S. PATENT DOCUMENTS

| | | | |
|---|---|---|---|
| 3,778,053 | 12/1973 | Smith, III et al. | 446/213 X |
| 4,749,183 | 6/1988 | Cho | 482/82 |
| 4,776,585 | 10/1988 | Maleyko et al. | 482/82 |
| 5,137,488 | 8/1992 | Yeh . | |
| 5,137,503 | 8/1992 | Yeh | 482/126 X |

*Primary Examiner*—Richard J. Apley
*Assistant Examiner*—Glenn E. Richman
*Attorney, Agent, or Firm*—Gene Scott

[57] ABSTRACT

An apparatus for emitting pre-programmed songs at a predetermined tempo or a selectable tempo of either one or two beats per rotation of the rope. The apparatus comprises a rope or like material, contained at each end by a handle. One handle includes an electrical circuit integrally contained within. The electrical circuit includes a storage means for storing ten or more songs, a sensing means for correlating the rotation of the rope with the emission of musical notes, an annunciator means to produce the notes, an external switch to select or deselect power to the circuit, a switch to select the desired tempo of the pre-programmed songs and a switch to select a particular song from the series of preprogrammed songs.

5 Claims, 3 Drawing Sheets

MUSICAL BEAT JUMP-ROPE

FIELD OF THE INVENTION

This invention relates generally to exercise equipment and playthings and more particularly to a jump rope capable of continuously playing ten or more pre-programmed songs either at an independent tempo, or at two selectable tempos of one or two musical beats per swing of the jump rope.

BACKGROUND OF THE INVENTION

Invention and use of jump ropes is known to the public, as they have been used as a form of cardiovascular exercise for many years. However, over the years jump ropes have become increasingly popular not only as a form of exercise but also a means of entertainment among children. Thus, innumerable sizes, styles and colors of jump ropes have been created to appeal to the tastes of children. One such modification of the jump rope has been to add a sound feature to the rope as it is rotated.

For example, U.S. Pat. No. 3,778,053 issued to Jay Smith, Gerald Schmidt and Lawrence T. Jones discloses a jump rope that produces a musical tone when it is rotated. The jump rope comprises an elongated flexible hollow tube with a plurality of apertures extending through the skin of the tube near its mid-length. The ends of the tube are rotatively connected to the ends of a pair of handles. At least one of these handles has a bulbous chamber forming a portion of the handle, with the interior of the chamber in communication with the interior of the tube. The outer end of the bulbous chamber flares into a bell-like horn section to form the other portion of the handle. A reed is positioned in the handle, approximately between the bulbous chamber and the horn section.

Thus, when the jump rope is in use and the tube swings around the user's body, the movement of the tube causes air to quickly pass over the tube's apertured surface. The centrifugal forces generated within the tube combined with the outside air passing over the apertured surfaces of the tube move air from the interior of the tube through the tube apertures. This evacuation of the interior of the tubing causes air to be drawn in, through the one handle, into the interior of the tube. As the air passes through the handle, it actuates the reed to set it in vibration. The bulbous chamber functions as a resonance cavity to cooperate with the reed to produce a musical tone which is amplified by the horn section of the handle.

While the reference illustrates that the invention is capable of producing musical tones consistent with the rotation of the rope, it also exposes several inherent drawbacks of the invention. First of all, the invention is a relatively simple system that produces sound through a series of apertures and a reed without requiring an internal electrical circuit. While this allows musical tones to be generated without using batteries, it limits the capacity of the rope to merely producing an erratic, limited range of tones, depending upon the velocity of the rope and the resulting vibration of the reed. Furthermore, this invention is constructed so that every time the rope is swung, a tone is produced. The invention has no provision to terminate the musical tones when desired. This limitation can become particularly aggravating when the rope is used by small children, who may tend to incessantly swing it at inappropriate times and places, leaving parents no option but to endure the resulting noise or confiscate the rope altogether.

In 1992, Peter Yeh introduced U.S. Pat. No. 5,137,488, detailing a sports rod equipped with sound reproducer. The rod is composed mainly of a first rod case and a second rod case, both being of hollow construction and made of plastic material by injection molding. The first and the second rod cases join to form a rod-shaped body with the central portion forming a hand grip and with both ends being circularly headed. The sports rod includes a sound reproducer, which in turn is provided with a speaker mounted on the speaker mount, and a circuit board containing an integrated circuit with music or exercise commands stored programmably therein. When the switch of the sports rod is turned on, the sound reproducing device of the sports rod begins producing the sound of music or exercise commands stored in the integrated circuit thereof.

However, while this reference discloses a sports rod that can produce a variety of music and sounds at the discretion of the user, it does not teach a jump rope-type rod and use. Instead, this prior art is designed to be used in place of a cheerleader's pompon or the like, for aesthetically pleasing waving and movement. The music feature of the prior art can be turned on and off, but the resulting music has no relation to the movement of the rod. Therefore, this invention is incapable of providing music at a tempo regulated by the movement of the invention. The present invention fulfills these needs and provides further related advantages.

SUMMARY OF THE INVENTION

The present invention is a jump rope capable of continuously playing ten or more pre-programmed songs at a set tempo or at a selectable tempo of either one or two musical beats per rotation of the rope.

The basic components of the new invention are a rope and a pair of handles. The rope can be made of braided or woven cloth, flexible plastic or a variety of other materials. It can also be constructed at varying lengths, so as to accommodate a single jumper or a plurality of jumpers. Each end of the rope is fitted through a hole at the end of each handle, with the rope end knotted or enlarged so that it cannot pass out the hole. The handles are elongate, cylindrical tubes that gradually widen as they move away from the rope end. The far end of the handles are closed, with a closure wall of one of the handles being removable. It is in this handle that the music supplying equipment is stored.

Unlike the relatively simple aperture and reed musical system of the Jones et al. reference, described above, the instant invention employs the use of an electrical circuit to improve the quality of the musical tone and provide more options and freedom for the user. The present invention produces musical tones by means of a battery powered motion sensor, circuit board and speaker. An on/off switch is located on the exterior of the handle, thus allowing the user to utilize the musical feature whenever desirable, but not necessitating it. Therefore, while the prior invention automatically emits a tone with every rotation of the rope, it is an object of the current invention to allow the tones to be emitted at the discretion of the user, thereby allowing the musical feature of the invention to be turned on and off without inhibiting the motion of the rope.

Likewise, it is an object of the invention to provide the user with a larger range of musical tones than previously offered. In fact, while the invention to Jones et al. is limited to merely producing an erratic, limited range of tones, depending upon the velocity of the rope and the vibration of the reed, the present invention actually plays a series of pre-programmed songs stored on a music chip located on an electric circuit board in the handle. Thus, it is an object of the present invention to provide increased entertainment and enjoyment by continuously playing ten or more pre-programmed songs.

In addition, neither Jones et al. nor Yeh provide an apparatus capable of playing music at variable tempos. Jones' invention emits tones at a tempo of one tone per rotation, while Yeh's invention plays songs or commands at the tempo appropriate to the particular song. However, it is an object of the present invention to combine both these tempo possibilities and provide an apparatus capable of playing music at either a fixed or adjustable tempo.

To accomplish this, the invention includes a tempo switch button on the exterior surface of the handle. By pressing the button a specific number of times, the apparatus plays songs stored on the music chip at the typical tempo appropriate for the song. Likewise, by pressing it a certain number of times the user can select a tempo of either one or two beats per rotation. This is accomplished by means of a switching circuit chip, located on the circuit board, and a motion sensor located in the handle nearest the rope end. When the tempo switch button is pushed once, the tempo is set at one beat of the song per revolution of the rope, and when it is pushed twice, the tempo is set at two beats of the song per revolution, and when it is pressed three times, it is set at a tempo independent of the rope's rotation. This information is relayed to the switching circuit, which activates the motion sensor for the desired tempo beat. With this adjustable tempo selectability, it becomes an object of the invention not only to entertain and engage children, but also to lend itself to avid exercisers who can pace and gauge their activity with the selected tempo of the apparatus.

Located past the circuit board in the wider portion of the handle is a chamber for two AAA batteries. It is therefore an object of the invention to provide musical features to a standard jump rope through means of an electrical circuit powered by batteries. The closure wall on the far end of the handle containing the circuit is removable, thereby allowing easy access for removal and replacement of the batteries. Included on the interior surface of this wall is a speaker, which works in conjunction with an amplifier chip, located on the circuit board, to transmit and amplify the sound of the produced music. It is thereby an object of the invention to produce music at an amplified tempo so as to be clearly heard by the jump roper while engaging in the exercise.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
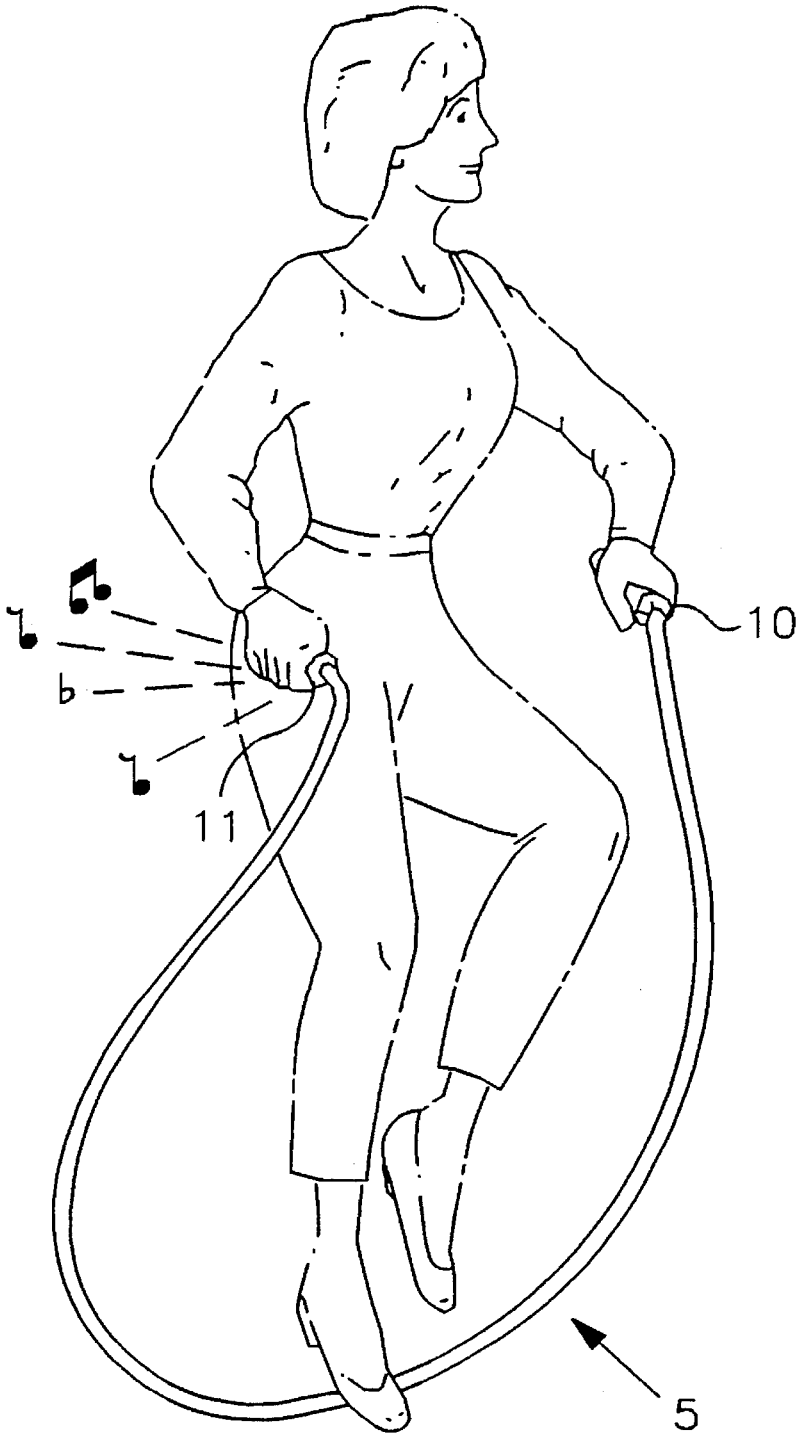
FIG. 1 is a perspective view of the invention in use showing opposing handles held by a user, and a rope being swung around the body of the user.

FIG. 1 shows a musical jump-rope that can continuously play ten or more pre-programmed songs. The songs can be played at their original tempo or at a selectable tempo of either one or two musical beats per rotation of the rope. The main components of the jump-rope are the rope 5 and the two handles 10 and 11.

The rope 5 is made of a durable, flexible material, such as braided or woven cloth, plastic tubing or a variety of other appropriate materials. The rope 5 must be long enough to easily be rotated around a human body as a half-loop, while the handles 10 and 11 are held in opposite hands. However, the rope 5 can be manufactured in varying lengths so as to accommodate different sized users, ranging from children to adults. In addition, it can also be manufactured long enough to allow two or more people to jump simultaneously.

Figure 2:
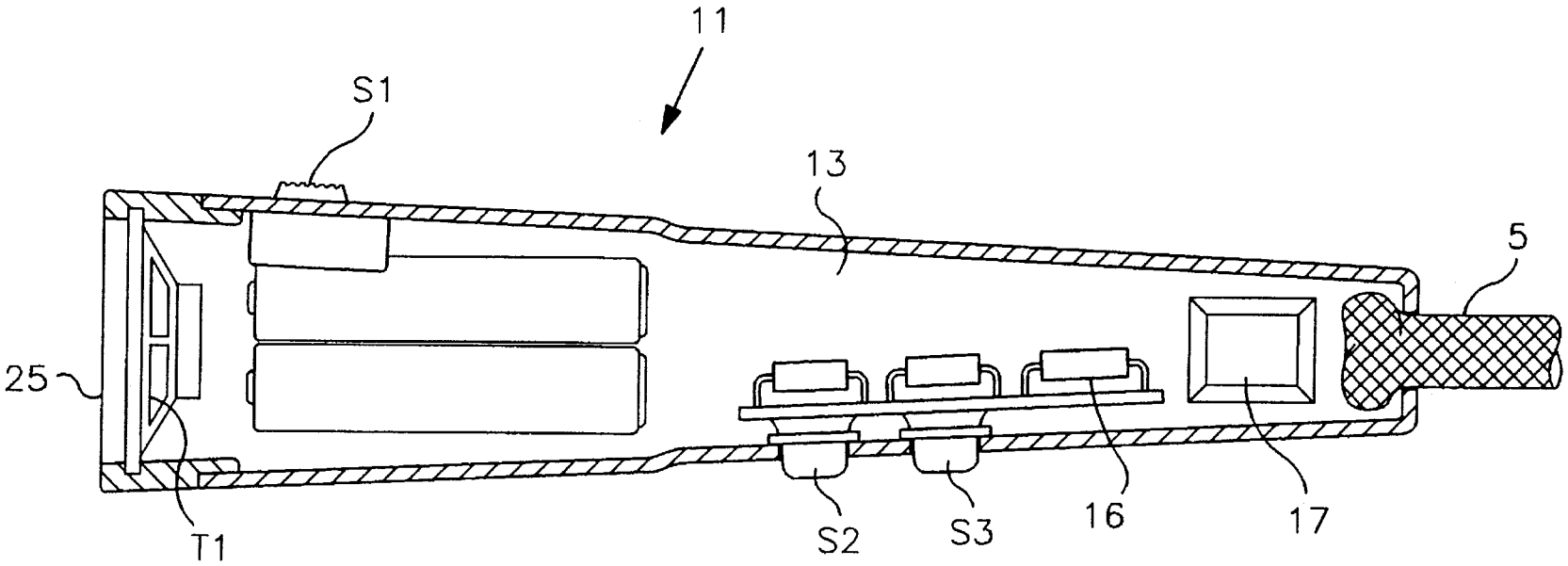
FIG. 2 is a side cut-away view of one of the handles of the invention showing the placement of elements of the electrical circuit of the invention.
Figure 4:
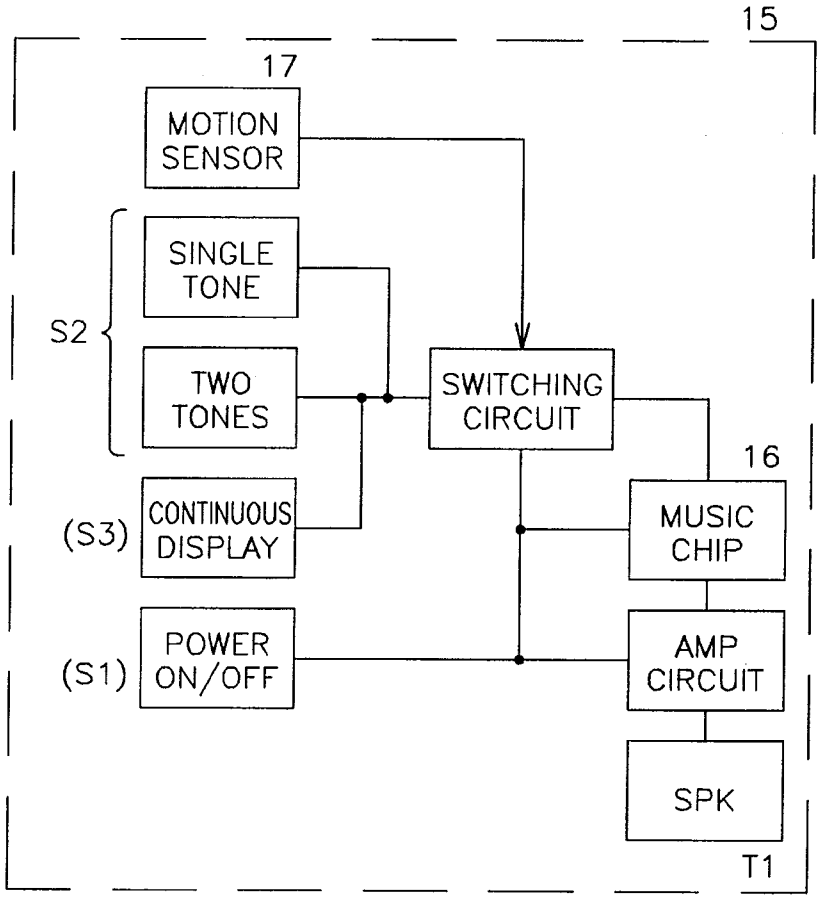
FIG. 4 is an overall block diagram of the invention.
Figure 3:
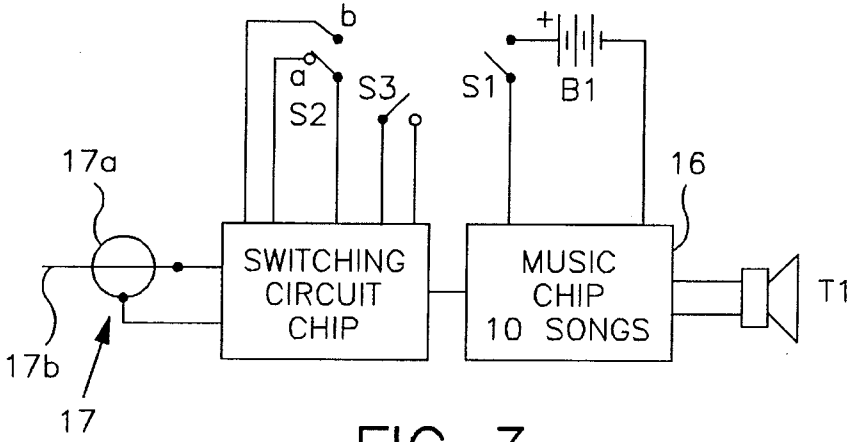
FIG. 3 is a schematic diagram showing the switching functions of the invention.

The handles 10 and 11 are secured to the ends of the rope 5 so that the rope 5 cannot be disengaged from the handles 10 and 11. Preferably, this is accomplished by knotting or separating the ends of the rope 5, although other similar securing measures are equally acceptable. One of the handles 11 provides an interior space 13, in which an electric circuit 15 is positioned. The electric circuit, as seen in FIG. 2, includes an electronic storage means 16, a sensing means 17, two music selecting switches (S2) and (S3), an annunciator means (T1) and a switch (S1) by which to select or deselect power to the electric circuit.

The storage means 16 is a solid-state electronic memory device. It stores at least one pre-programmed song, and preferably stores up to ten or more songs. The preprogrammed stored songs can be of infinite variety, specific to the target market of each jump rope, be it children, competitive athletes or the like.

The sensing means 17 is responsive to motion of the handle 11. The sensing means 17 is an electrical switch with a first and second electrode, 17A and 17B, in operative relationship. Although several different motion sensing mechanisms can be utilized, preferably the first electrode 17A is an electrically conductive wire in the shape of at least one part of a loop, and the second electrode 17B is an electrically conductive linear spring positioned nominally at the center of the loop shape. Thus, inertial forces on the second electrode result in spring action bending of the second electrode 17B so that contact between the electrodes results. Each rotation of the jump-rope produces the inertial force to cause such contact, and each contact of the electrodes causes the electric circuit 15 to emit at least one audible note of a song contained in the storage means 16.

The user can select the number of notes emitted each rotation of the rope by the second switching means (S2), which is positioned at an aperture in the handle 11 so as to be available to the user. The switching means (S2) allows the user to select between three modes of musical play, so that when the switch (S2) is pressed once, the circuit provides means for producing a single note of the music with each rotation of the jump-rope. When the switch (S2) is pressed twice, the circuit produces two notes of the music per rotation of the jump-rope, and when it is pressed a third time, the circuit plays the stored songs continuously, at a tempo independent of the rotation of the rope. Alternatively, two or even three separate switches could be provided to select each of these tempo options. In addition, while the preferred switch embodiment for this, and the other two external switching means included in this invention, is that of a push-button type switch, a toggle switch, slide switch or any other appropriate switching mechanism could also be utilized.

Switching means (S3) is provided so that the user can select a particular desired song from the plurality of songs stored within the storage means 16. With each push of the switch (S3), a different stored song begins playing. The user simply continues to press the switch (S3) until the desired song is heard. If the user does not utilize the switch (S3) to select a particular song, the series of stored songs will automatically play in their pre-programmed order at a tempo selected with the second switching means (S2).

The electric circuit 15 further includes the annunciator means T1, preferably a speaker, that audibly produces the musical notes of the stored songs.

The electric circuit 15 is preferably powered by batteries B1 that are positionable in the handle's interior space 13. Preferably, a pop-off or hingably mounted closure wall 25 is included at the end of the handle so as to protect the various components of the electric circuit contained within the handle. The closure wall 25 also provides means by which to access the batteries for replacement.

The power of the electric circuit 15 is controlled by the first switching means (S1) that is positioned at an aperture in the handle so as to be externally accessed. Thus, whenever it is undesirable to employ the electric circuit to play music, whether during jump-rope use or non-use periods, the switch (S1) is simply moved to the off position, and when it is desired to employ the musical features of the jump-rope, the switch (S1) is moved into the on position.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A musical jump-rope comprising:

a pair of jump-rope handles attached to opposing ends of a flexible rope, the rope having a length sufficient for rotating around a persons' body as a half-loop, while holding the handles;

one of the handles providing an interior space containing an electric circuit including a sensing means responsive to motion of the one of the handles, and further including a storage means for storing at least one song; each swing of the jump-rope causing the sensing means to cause the circuit to emit at least one audible note of the song in sequence with each turn of the jump-rope;

the sensing means providing a first and a second electrodes in operative relationship, the first electrode being an electrically conductive stationary wire in the shape of at least one part of a loop, the second electrode being an electrically conductive linear spring positioned nominally at the center of the loop shape, the second electrode constructed so as to bend under inertial forces delivered thereto as a result of jumping rope so that periodic contact between the electrodes results.

2. The musical jump-rope of claim 1 further including a switching means for selecting the at least one song from a plurality of songs stored within the storage means.

3. The musical jump-rope of claim 1 wherein the storage means is a solid-state electronic memory device.

4. The musical jump-rope of claim 3 wherein the electric circuit further includes a first switching means for selecting between three modes of musical play, and a second switching means for selecting and deselecting power to the electric circuit, the first and second switching means being positioned at apertures in the one handle, for external adjustment, and further including an annunciator means for producing audible musical notes and other sounds.

5. The musical jump-rope of claim 4 wherein the circuit provides means for producing a single note of the music with each rotation of the jump-rope, and for producing two notes of the music with each rotation of the jump-rope, and for playing the music continuously without rotating the rope, as selected by the first switching means.

* * * * *